US008887413B2

(12) United States Patent
Miller

(10) Patent No.: US 8,887,413 B2
(45) Date of Patent: Nov. 18, 2014

(54) EXPANDING MATERIAL BOX FOR EQUIPMENT

(76) Inventor: Thomas Andrew Miller, Waterloo, IN (US)

( * ) Notice: Subject to any disclaimer, the term of this patent is extended or adjusted under 35 U.S.C. 154(b) by 0 days.

(21) Appl. No.: 13/372,470

(22) Filed: Feb. 13, 2012

(65) Prior Publication Data

US 2013/0206433 A1 Aug. 15, 2013

(51) Int. Cl.
*E01H 5/06* (2006.01)

(52) U.S. Cl.
USPC ..... 37/281; 37/444; 37/279

(58) Field of Classification Search
CPC ..... E01H 5/06; E01H 5/065; E02F 3/815; E02F 3/76; E02F 3/7654; E02F 3/8155
USPC ..... 37/444, 266, 274, 279, 281
See application file for complete search history.

(56) References Cited

U.S. PATENT DOCUMENTS

| | | | | | |
|---|---|---|---|---|---|
| 3,039,209 | A * | 6/1962 | Cron et al. | ..... | 37/403 |
| 4,073,077 | A * | 2/1978 | Essel et al. | ..... | 37/281 |
| RE31,045 | E * | 10/1982 | Essell et al. | ..... | 37/281 |
| 5,638,618 | A * | 6/1997 | Niemela et al. | ..... | 37/281 |
| 6,408,549 | B1 * | 6/2002 | Quenzi et al. | ..... | 37/281 |
| 6,412,199 | B1 * | 7/2002 | Quenzi et al. | ..... | 37/281 |
| 6,425,196 | B1 * | 7/2002 | Weagley et al. | ..... | 37/270 |
| 6,442,877 | B1 * | 9/2002 | Quenzi et al. | ..... | 37/281 |
| 7,000,338 | B2 * | 2/2006 | Savard | ..... | 37/274 |
| 7,429,158 | B2 * | 9/2008 | McFarland | ..... | 414/722 |
| 7,481,011 | B2 * | 1/2009 | Nesseth | ..... | 37/281 |
| 7,658,022 | B2 * | 2/2010 | Strait | ..... | 37/232 |
| 7,681,337 | B2 * | 3/2010 | Watson | ..... | 37/281 |
| 2007/0089327 | A1 * | 4/2007 | Watson | ..... | 37/281 |
| 2009/0307943 | A1 * | 12/2009 | Buckbee et al. | ..... | 37/266 |

* cited by examiner

*Primary Examiner* — Thomas B Will
*Assistant Examiner* — Jessica H Lutz
(74) *Attorney, Agent, or Firm* — Taylor IP, P.C.

(57) ABSTRACT

A material box can telescope between larger and smaller widths to accommodate legal requirements of traveling down the road, making traveling between job sites easier and safer than conventional, unadjustable material boxes. The material box can be used in a wide configuration to plow a wider area, such as empty parking lots, cutting down work time. When cars are present, the material box can be made narrow to accommodate for the vehicles while still being an effective material moving device.

9 Claims, 4 Drawing Sheets

EXPANDING MATERIAL BOX FOR EQUIPMENT

BACKGROUND OF THE INVENTION

The present invention relates to material boxes and, more particularly, to an expanding material box for equipment.

Transporting a material box between locations can be dangerous and illegal, depending on the size of the box. Moreover, to accommodate locations where travel width varies, such as parking lots, multiple size boxes may be needed.

As can be seen, there is a need for an improved material box that has an adjustable width to permit legal and safe transportation while adjusting in size to allow for various applications.

SUMMARY OF THE INVENTION

In one aspect of the present invention, a material box assembly comprises a center blade assembly having a center main blade; a channel formed on a back side of the center blade assembly; at least one wing blade assembly having a wing blade; and a wing blade slide formed on a back side of the wing blade assembly, the wing blade slide adapted to slidably engage with the channel to adjust the width of the material box.

In another aspect of the present invention, a material box assembly, comprises a center blade assembly having a center main blade; a channel formed on a back side of the center blade assembly; first and second wing blade assemblies, each having a wing blade, disposed on each side of the center blade assembly; a wing blade slide formed on a back side of the wing blade assemblies, the wing blade slide adapted to slidably engage with the channel to adjust the width of the material box; at least one slide disposed along the wing blade slide, the at least one slide adapted to reduce friction between the channel and the wing blade slide; a center main blade slide disposed along a top back portion of at least one side of the center main blade, the center main blade slide adapted to reduce friction between the center main blade and the wing blade and structural supports disposed along the center main blade and the wing blades.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a material box that can telescope between larger and smaller widths to accommodate legal requirements of traveling down the road, making traveling between job sites easier and safer than conventional, unadjustable material boxes. The material box can be used in a wide configuration to plow a wider area, such as empty parking lots, cutting down work time. When cars are present, the material box can be made narrow to accommodate for the vehicles while still being an effective material moving device.

Figure 1:
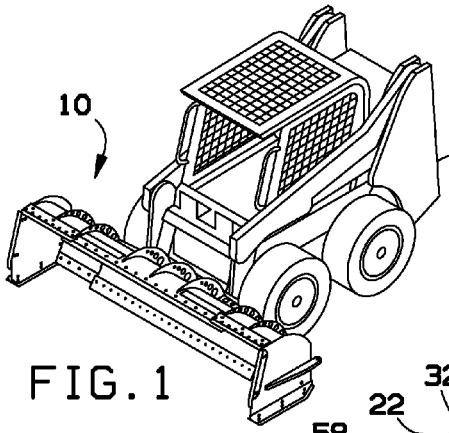
FIG. 1 is a perspective view of an adjustable material box, in use, according to an exemplary embodiment of the present invention.
Figure 2:
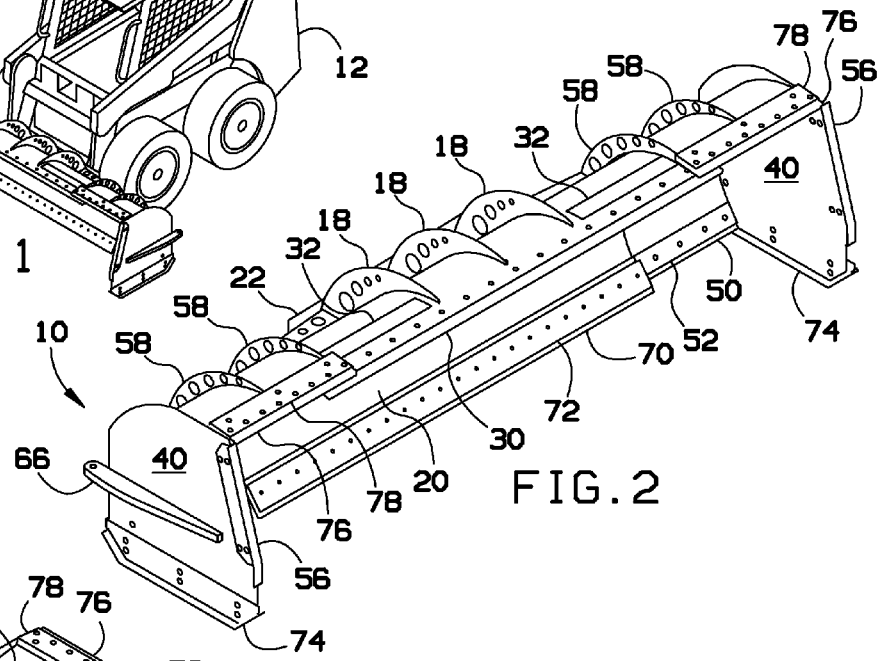
FIG. 2 is a front perspective view of the adjustable material box of FIG. 1.
Figure 3:
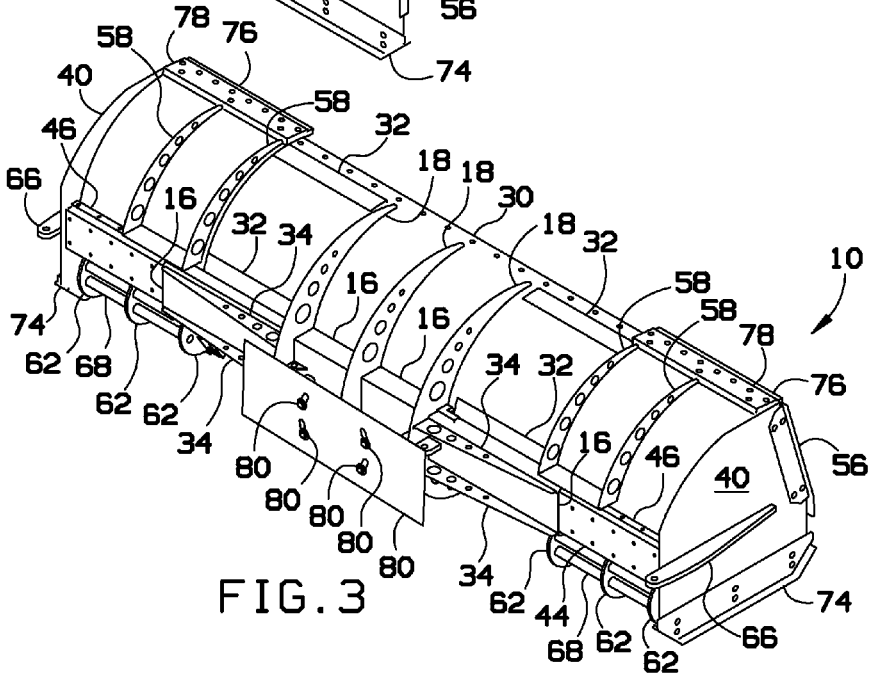
FIG. 3 is a rear perspective view of the adjustable material box of FIG. 1.
Figure 4:
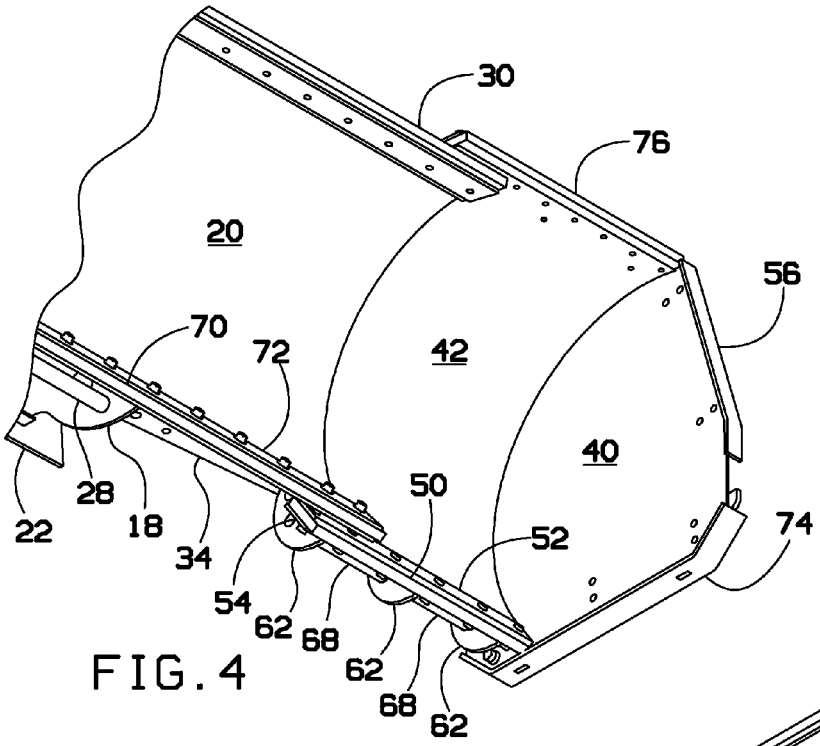
FIG. 4 is a perspective view of a bottom right side of the adjustable material box of FIG. 1.
Figure 5:
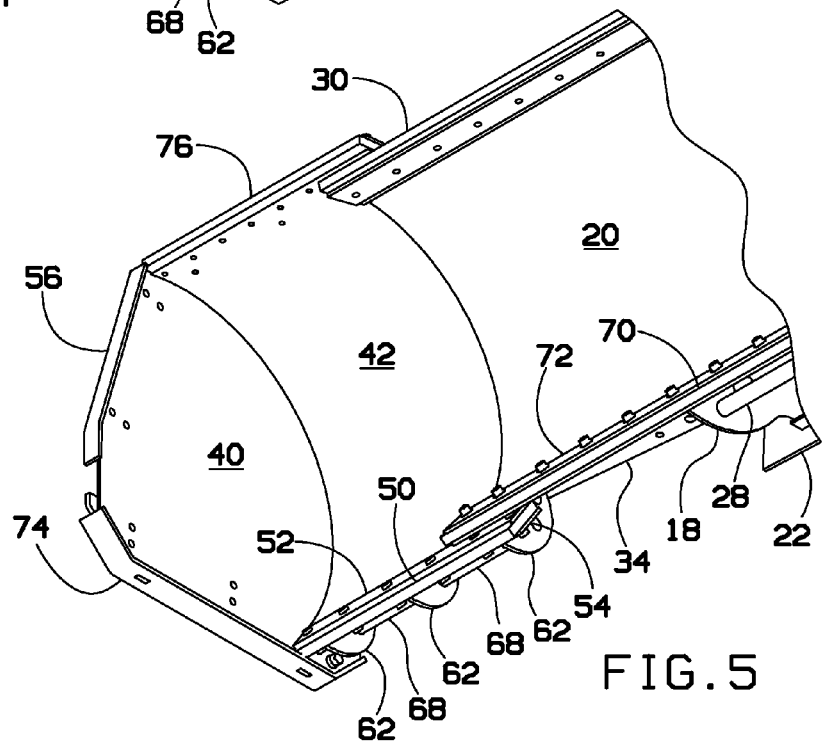
FIG. 5 is a perspective view of a bottom left side of the adjustable material box of FIG. 1.
Figure 6:
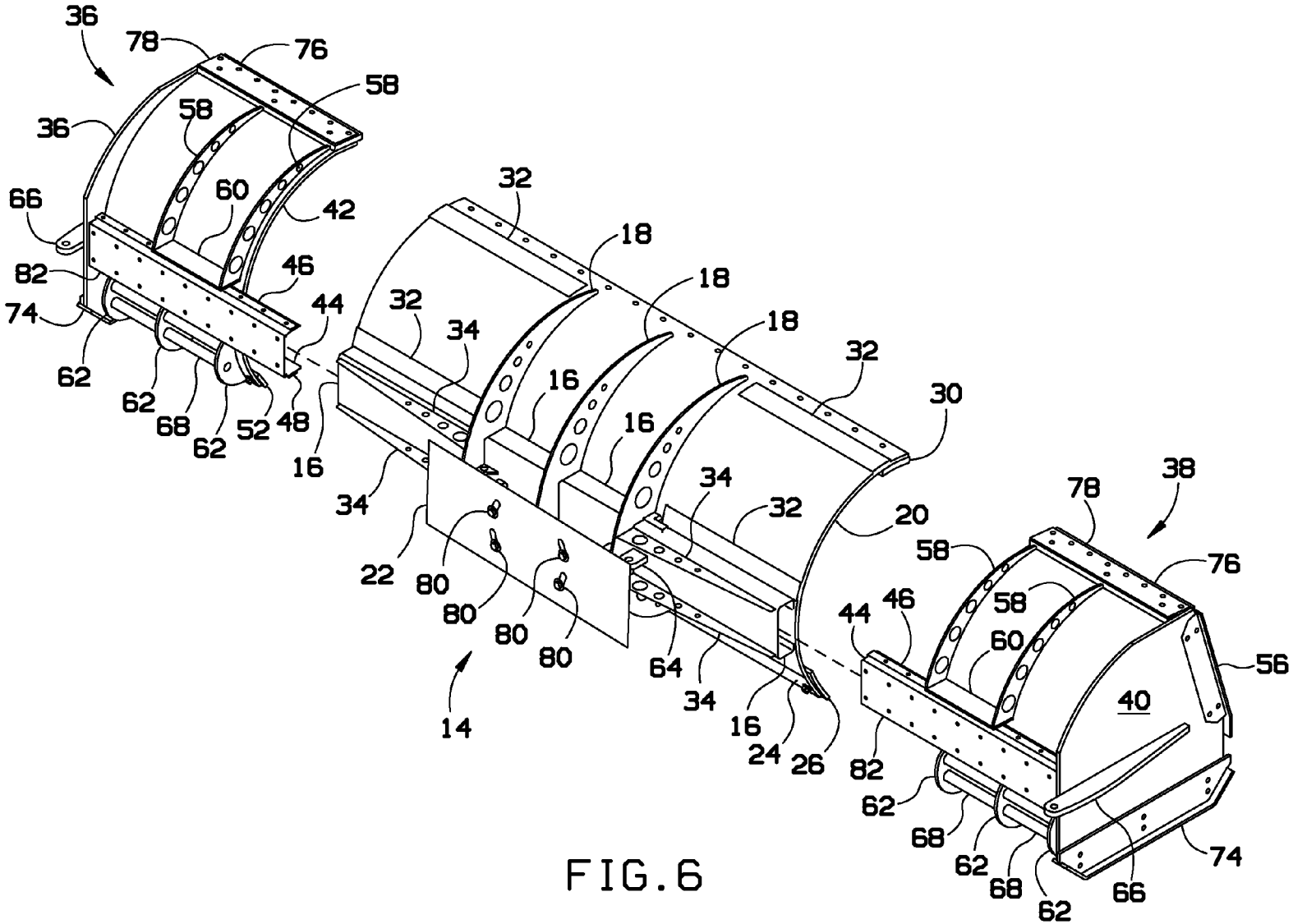
FIG. 6 is an exploded perspective view of the adjustable material box of FIG. 1.
Figure 7:
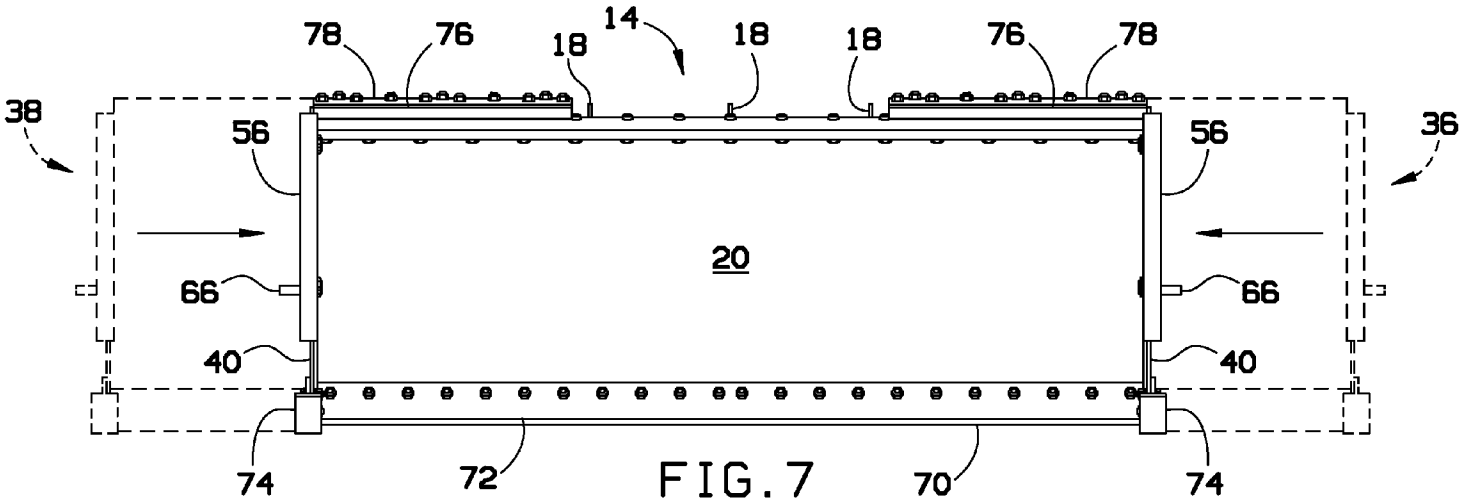
FIG. 7 is a front view of the adjustable material box of FIG. 1 with wing assemblies closed.
Figure 8:
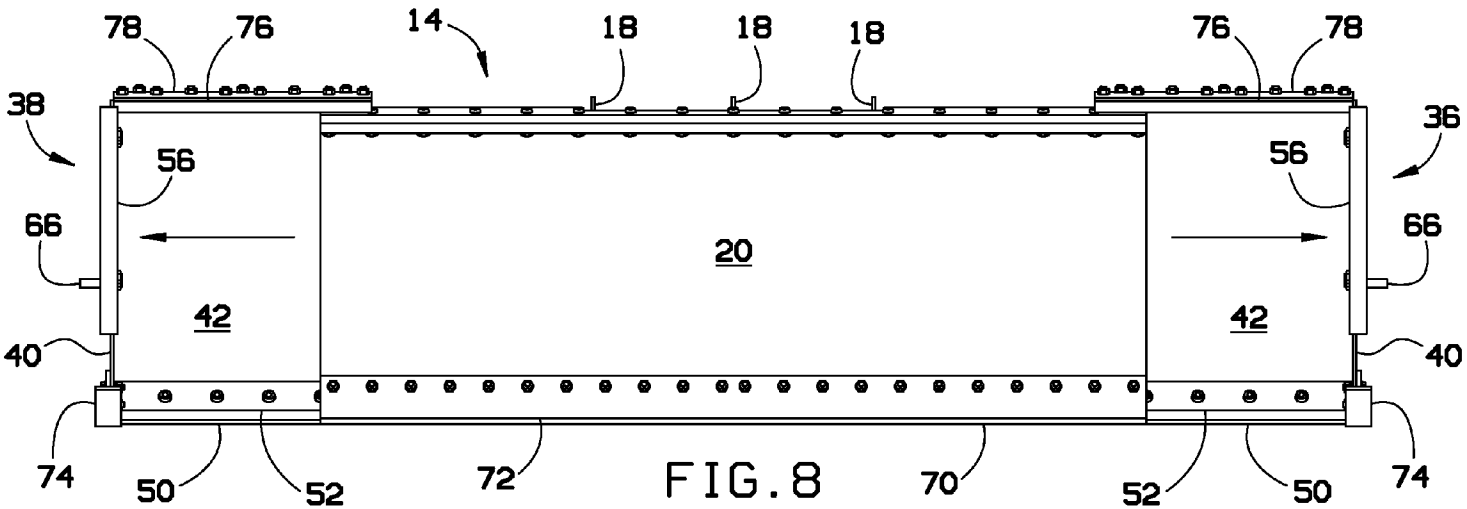
FIG. 8 is a front view of the adjustable material box of FIG. 1 with wing assemblies open.

Referring now to FIGS. 1 through 8, a material box assembly 10 may be used by, for example, a skid loader 12 for moving material in applications such as landscape, agricultural, snow removal and the like. The material box assembly 10 may include a center blade assembly 14 and one or two adjustable wing blade assemblies 36, 38. The center blade assembly 14 may include a mount 22 for attaching the material box assembly 10 to the skid loader 12. Other mounts may be used depending on the application. Mount hardware 80 may be used to attach the mount 22 to the center blade assembly 14.

A main C-channel frame 16 may be disposed on the back side of the center blade assembly 14. The main C-channel frame 16 may slidably accept wing blade slides 44 from the wing blade assemblies 36, 38. When the wing blade assemblies 36, 38 are slid onto the main C-channel frame 16, the wing blades 42 slide behind a center main blade 20 of the center blade assembly 14.

In a narrow configuration (FIG. 7), the wing blade assemblies 36, 38 may be fully slid onto the center blade assembly 14 so that wing blade sides 40 are adjacent to the edges of the center main blade 20. In a wide configuration (FIG. 8), the wing blade assemblies 36, 38 may be extended outward, away from the center main blade 20. Hydraulics (not shown) may be used to adjust the wing blade assembly 36, 38. A hydraulic cylinder (not shown), for example, may connect between outer ram mounts 66 of the wing blade assembly 36, 38 and inner ram mounts 64 on the center blade assembly. In some embodiments, the wing blade assemblies 36, 38 may be manually moved between positions. In this manual embodiment, pins (not shown) may be inserted through the main C-channel frame 16 and the wing blade slide 44 to hold the wing blade assemblies 36, 38 in a desired position.

To provide smooth adjustment of the width of the material box assembly 10, slides may be provided at various locations. For example, an upper wing blade slide 46 and a lower wing blade slide 48 may be disposed on each side of the wing blade slides 44. These slides 46, 48 may provide ease of motion of the wing blade slides 44 within the main C-channel frames 16. In addition, a center main blade slide 32 may be disposed on the center blade assembly 14. These slides 32 may provide ease of motion of the wing blades 42 over the center main blade 20. Additionally, a wing blade rear slide 82 may be disposed on the wing blades 42. The slides may be made of a durable material that may permit ease of motion between the sliding parts. For example, the slides may be made from a hard, smooth plastic.

Support structures may be included in the material box assembly 10. For example, located above the main C-channel frame 16, center gussets 18 may run along a back side of the center main blade 20. Likewise, located above the wing blade slides 44, wing upper gussets 58 may run along a back side of the wing blades 42. Wing upper gusset lower supports 60 may interconnect the wing upper gussets 58 adjacent to the wing blade slides 44. Below the wing blade slides 44, wing lower cutting edge gussets 62 may be disposed with wing lower gusset pipes 68 interconnecting the wing lower cutting edge gussets 62. Similarly, below the main C-channel frame 16 on the center blade assembly 14, pipes 28 may be disposed for support. Additionally, along the main C-channel frame 16, main C-channel gussets 34 may be disposed to provide additional support for the main C-channel frame 16.

Additional components may be included on the material box assembly 10, such as a cutting edge backing plate 24 and a center rubber 26 disposed along a scraping edge of the center main blade 20. A front center cutting edge 30 may be disposed on a cutting edge of the center main blade 20. Similarly, the wing blade assemblies 36, 38 may include a wing back drag cutting edge 76 and a wing back drag backing plate 78 on a cutting edge of the wing blade 42. A back drag rubber edge 70 and a back drag cutting edge 72 may be disposed on the center main blade 20, while a wing front cutting blade 50 and a wing rubber slider 52 may be disposed on the wing blades 42. Wing rear backing plates 54 may be disposed behind the wing front cutting blades 50. Back drag skis 74 may be disposed on each end of the bottom of the wing blades 42. Wing blade side skis 56 may be disposed along the leading front edges of the wing blade sides 40.

While the above description and drawings describe a material box assembly having adjustable wings on both sides thereof, in some embodiments, only one side of the material box assembly may be adjustable. Moreover, while the above description and drawings describe a material box assembly that is adjustable, the present invention may include other attachments having a similar adjustment mechanism, such as plows, box blades, rakes, and the like.

It should be understood, of course, that the foregoing relates to exemplary embodiments of the invention and that modifications may be made without departing from the spirit and scope of the invention as set forth in the following claims.

What is claimed is:

1. A material box assembly comprising:

a center blade assembly having a center main blade, said main blade having a curved plate structure, said center main blade has a plurality of generally vertically arranged center gussets which are laterally spaced apart from each other, said center main blade having an absence of said center gussets at each lateral end of said center main blade;

a channel directly attached to a back side of and extending a full width of the curved plate structure of the center main blade so as to define an integral structural support for the center blade assembly, said channel having a C-shaped cross sectional shape with a pair of opposed lips engaging and attached to the curved plate structure, each of said lips extending toward its opposing lip, said channel and the back side of said center main blade defining a first gap therebetween at each lateral end of said channel; and at least one wing blade assembly having a wing blade, wherein said at least one wing blade assembly includes a wing blade slide that is slidably engaged only with the channel and not the main blade to adjust the width of the material box, each said wing blade slide and a back of said corresponding wing blade defining a second gap therebetween, whereby said wing blade is slidable in transverse directions within said first gap at the back side of the center main blade, each said wing blade slide having a cross sectional shape which mates with and slides within said C-shaped cross sectional shape of a corresponding said channel, each said wing blade being positioned behind said center main blade and having a curvature that mates with the back side of the center main blade and allows transverse sliding of the wing blade relative to the center main blade.

2. The material box assembly of claim 1, further comprising at least one slide disposed along the wing blade slide, the at least one slide reducing friction between the channel and the wing blade slide.

3. The material box assembly of claim 1, further comprising a center main blade slide disposed along a top back portion of at least one side of the center main blade, the center main blade slide reducing friction between the center main blade and the wing blade.

4. The material box assembly of claim 1, further comprising at least one wing upper gusset on each wing blade and at least one lower cutting edge gusset on each wing blade.

5. The material box assembly of claim 1, further comprising:

an inner ram mount disposed on the center blade assembly; and at least one outer ram mount, each of the said at least one outer ram mount disposed on a respective said at least one wing blade assembly.

6. The material box assembly of claim 1, further comprising a mount adapted to attach the material box assembly to a vehicle.

7. A material box assembly, comprising:

a center blade assembly having a center main blade, said main blade having a curved plate structure, said center main blade has a plurality of generally vertically arranged center gussets which are laterally spaced apart from each other, said center main blade having an absence of said center gussets at each lateral end of said center main blade;

a channel directly attached to a back side of and extending a full width of the curved plate structure of the center main blade so as to define an integral structural support for the center blade assembly, said channel having a C-shaped cross sectional shape with a pair of opposed lips engaging and attached to the curved plate structure, each of said lips extending toward its opposing lip, said channel and the back side of said center main blade defining a first gap therebetween at each lateral end of said channel;

first and second wing blade assemblies, each having a wing blade, disposed on each side of the center blade assembly;

a wing blade slide formed on a back side of each of the wing blade assemblies, each wing blade slide being slidably engaged only with the channel and not the main blade to adjust the width of the material box, each said wing blade slide and a back of said corresponding wing blade defining a second gap therebetween, whereby said wing blade is slidable in transverse directions within said first gap at the back side of the center main blade, each said wing blade slide having a cross sectional shape which mates with and slides within said C-shaped cross sectional shape of a corresponding said channel;

at least one slide disposed along the wing blade slide, the at least one slide reducing friction between the channel and the wing blade slide; and a center main blade slide disposed along a top back portion of at least one side of the center main blade, the center main blade slide reducing friction between the center main blade and the wing blade, said center main blade being positioned in front of each said wing blade and having a back with a curvature which mates with a curvature of each said wing blade and allows transverse sliding of the wing blades relative to the center main blade.

8. A material box assembly, comprising:

a center blade assembly having a center main blade, said main blade having a curved plate structure, said center main blade has a plurality of generally vertically arranged center gussets which are laterally spaced apart from each other, said center main blade having an absence of said center gussets at each lateral end of said center main blade;

a channel directly attached to a back side of and extending a full width of the curved plate structure of the center main blade so as to define an integral structural support for the center blade assembly, said channel having a C-shaped cross sectional shape with a pair of opposed lips engaging and attached to the curved plate structure, each of said lips extending toward its opposing lip, said channel and the back side of said center main blade defining a first gap therebetween at each lateral end of said channel;

first and second wing blade assemblies, each having a wing blade, disposed on each side of the center blade assembly, each said wing blade being positioned behind said center main blade and having a curvature that mates with a back of the center main blade and allows transverse sliding of the wing blade relative to the center main blade; and a wing blade slide formed on a back side of each of the wing blade assemblies, the wing blade slide being slidably received within the channel so as to engage only the channel and not the main blade, such that each of the wing blade assemblies are movable relative to the center blade assembly to adjust the width of the material box, each said wing blade slide and a back of said corresponding wing blade defining a second gap therebetween, whereby said wing blade is slidable in transverse directions within said first gap at the back side of the center main blade, each said wing blade slide having a cross sectional shape which mates with and slides within said C-shaped cross sectional shape of a corresponding said channel.

9. The material box assembly of claim 8 further comprising at least one slide member disposed along the wing blade slide, wherein the at least one slide member reduces the friction between the channel and the wing blade slide during movement therebetween.

* * * * *